US010024102B2

(12) United States Patent
Mitchell et al.

(10) Patent No.: US 10,024,102 B2
(45) Date of Patent: Jul. 17, 2018

(54) OSCILLATING MUD MOTOR

(71) Applicant: WWT NORTH AMERICA HOLDINGS, INC., Houston, TX (US)

(72) Inventors: Sarah Mitchell, Fullerton, CA (US); Philip Wayne Mock, Costa Mesa, CA (US)

(73) Assignee: WWT North America Holdings, Inc., Houston, TX (US)

( * ) Notice: Subject to any disclaimer, the term of this patent is extended or adjusted under 35 U.S.C. 154(b) by 293 days.

(21) Appl. No.: 14/965,814

(22) Filed: Dec. 10, 2015

(65) Prior Publication Data

US 2016/0168912 A1 Jun. 16, 2016

Related U.S. Application Data

(60) Provisional application No. 62/091,271, filed on Dec. 12, 2014.

(51) Int. Cl.
*E21B 4/02* (2006.01)
*E21B 17/14* (2006.01)

(52) U.S. Cl.
CPC ..... *E21B 4/02* (2013.01); *E21B 17/14* (2013.01)

(58) Field of Classification Search
None
See application file for complete search history.

(56) References Cited

U.S. PATENT DOCUMENTS

| | | | | |
|---|---|---|---|---|
| 4,354,524 | A * | 10/1982 | Higgins | E21B 43/122 137/624.13 |
| 4,546,836 | A * | 10/1985 | Dennis | E21B 4/003 175/107 |
| 7,086,486 | B2 * | 8/2006 | Ravensbergen | E21B 4/02 175/107 |
| 7,275,605 | B2 | 10/2007 | Smith et al. | |
| 8,567,511 | B2 | 10/2013 | Loree | |
| 2003/0051919 | A1 * | 3/2003 | Moore | E21B 4/18 175/73 |
| 2011/0061936 | A1 | 3/2011 | Bui et al. | |
| 2011/0100623 | A1 * | 5/2011 | Bebb | E21B 41/00 166/250.01 |
| 2012/0097451 | A1 | 4/2012 | Mock | |
| 2014/0231144 | A1 | 8/2014 | Sonar et al. | |
| 2016/0160565 | A1 * | 6/2016 | Breckenridge | E21B 4/02 175/107 |
| 2016/0251920 | A1 * | 9/2016 | Galley | E21B 34/08 175/25 |

OTHER PUBLICATIONS

International Search Report and Written Opinion issued in International Application No. PCT/US2015/065332; dated Feb. 25, 2016; 9 pages.

Wilson, Adam. "Rotation by Reciprocation Casing-Landing Technology". *Journal of Petroleum Technology* (*JPT*), Dec. 2015, pp. 81-82.

* cited by examiner

*Primary Examiner* — Shane Bomar
(74) *Attorney, Agent, or Firm* — Lewis Roca Rothgerber Christie LLP

(57) ABSTRACT

An oscillating mud motor having a valve section and a piston section positioned within a hollow cylindrical housing wherein the valve section comprises a timing cycle valve and a spool valve which hydraulically controls rotational movement of a piston on a central shaft in the piston section for linear reciprocation within the housing.

17 Claims, 4 Drawing Sheets

OSCILLATING MUD MOTOR

CROSS-REFERENCE TO RELATED APPLICATION(S)

This application claims the benefit of and priority to U.S. Provisional Application No. 62/091,271 filed Dec. 12, 2014, the entire contents of which are incorporated herein by reference

BACKGROUND OF THE INVENTION

The present invention is directed to a down hole tool, and more particularly to an oscillating mud motor to provide rotational reciprocation for a reamer shoe.

In oil and gas exploration and production operations, bores are drilled to gain access to subsurface hydrocarbon-bearing formations. The bores are typically lined with steel tubing, known as tubing, casing or liner, depending upon diameter, location and function. The tubing is run into the drilled bore from the surface and suspended or secured in the bore by appropriate means, such as a casing or a liner hanger. For a casing, cement may be then introduced into the annulus between the tubing and the bore wall.

As the tubing is run into the bore, the tubing end will encounter irregularities and restrictions in the bore wall, for example ledges formed where the bore passes between different formations and areas where the bore diameter decreases due to swelling of the surrounding formation. Further, debris may collect in the bore, particularly in highly deviated or horizontal bores. Accordingly, the tubing end may be subjected to wear and damage as the tubing is lowered into the bore. These difficulties may be alleviated by providing a shoe on the tubing end. Examples of casing shoes of various forms are well known in the art.

Another problem encountered is the difficulty of running casing through built sections. More specifically, there is difficulty in running large diameter casing through the build section of a well in moderate to soft formations. The stiffness of the casing requires a significant force that must be generated at the casing shoe to cause the casing to bend to follow the curved section of the wellbore.

Often times a reamer bit is attached to the bottom of a casing shoe for opening the hole in smoothing areas that may have ledges or under-gauge areas where the diameter of the hole is not large enough to allow passage of the casing. In certain applications a mud motor is incorporated to help operate the reamer shoe. Most mud motors have a progressive cavity power section which are not hollow but require drilling fluid to pass through the power section. This means that stalling the motor creates a pressure spike which can be detrimental to other pressure activated tools within the bottom hole assembly. Another problem with current wellbore liner and completion systems is that they require turning to the left or to the right a certain number of revolutions to set the hanger. By oscillating back and forth, current tools generate torque in both directions, but overall does not generate any net rotation so current tools would not turn the casing, liner or completion.

Mud motors are also incorporated into traditional drill strings including drill pipe and a drill bit, and they also suffer from the same problems when incorporated therein as in casing and liner configurations. Consequently a need exists for an improved mud motor design which addresses the problem of prior designs.

SUMMARY OF THE INVENTION

The present invention is directed to an oscillating mud motor which incorporates a rotationally reciprocating element controlled by a 4-way hydraulic valve incorporated to operate a hydraulic cylinder, piston and shaft design. The oscillating 4-way hydraulic valve causes an axial movement in a hydraulic piston located between a central shaft and an outer cylinder of the motor. The piston is rotationally coupled to the shaft by way of a keyed shaft. The piston includes a helical surface which causes an outer cylinder of the tool to rotate relative to the shaft. As the piston moves forward and backwards on the shaft, the linear motion is translated into oscillating angular motion relative to the shaft.

The hydraulic motion of the tool is controlled using a timing cycle valve, and a 4-way valve. The timing valve uses a turbine rotor that spins when differential pressure in the formation is applied between the center line fluid and the annulus of the drill string. The spinning turbine is slowed using a series of gears and turned into reciprocating linear motion to drive the 4-way valve. This configuration cycles the valve back and forth at a rate proportional to flow rate through the turbine, which is in turn proportional to the flow rate and differential pressure present within the drill string or casing string.

A benefit of the invention over previous mud motor designs is the improved ease of manufacturing and sealing the components required to generate a differential pressure required to generate force within the system. The oscillating mud motor of the present invention is hollow with a clear center bore allowing drilling fluid flow, and allowing drilling additional sections through the tool. The design generates sufficient torque to produce the necessary weight on bit envelope, improving drilling speeds and power output available. The mud motor provides oscillation such that the tool generates torque sufficient for casing, liner and completion systems. The oscillating mud motor of the present invention further provides the advantage of only requiring a small percentage of the differential pressure to flow through the tool to operate at the necessary operating conditions such that if the system includes other pressure sensitive tools below the motor, stalling of the oscillating mud motor will not cause a significant spike in pressure. The mud motor of the present invention is ideal for applications where other sensitive pressure-activated tools are required. Another advantage is that the mud motor does not increase overlap of the liner string nor does it interfere with current cementing practices.

DETAILED DESCRIPTION

Figure 1:
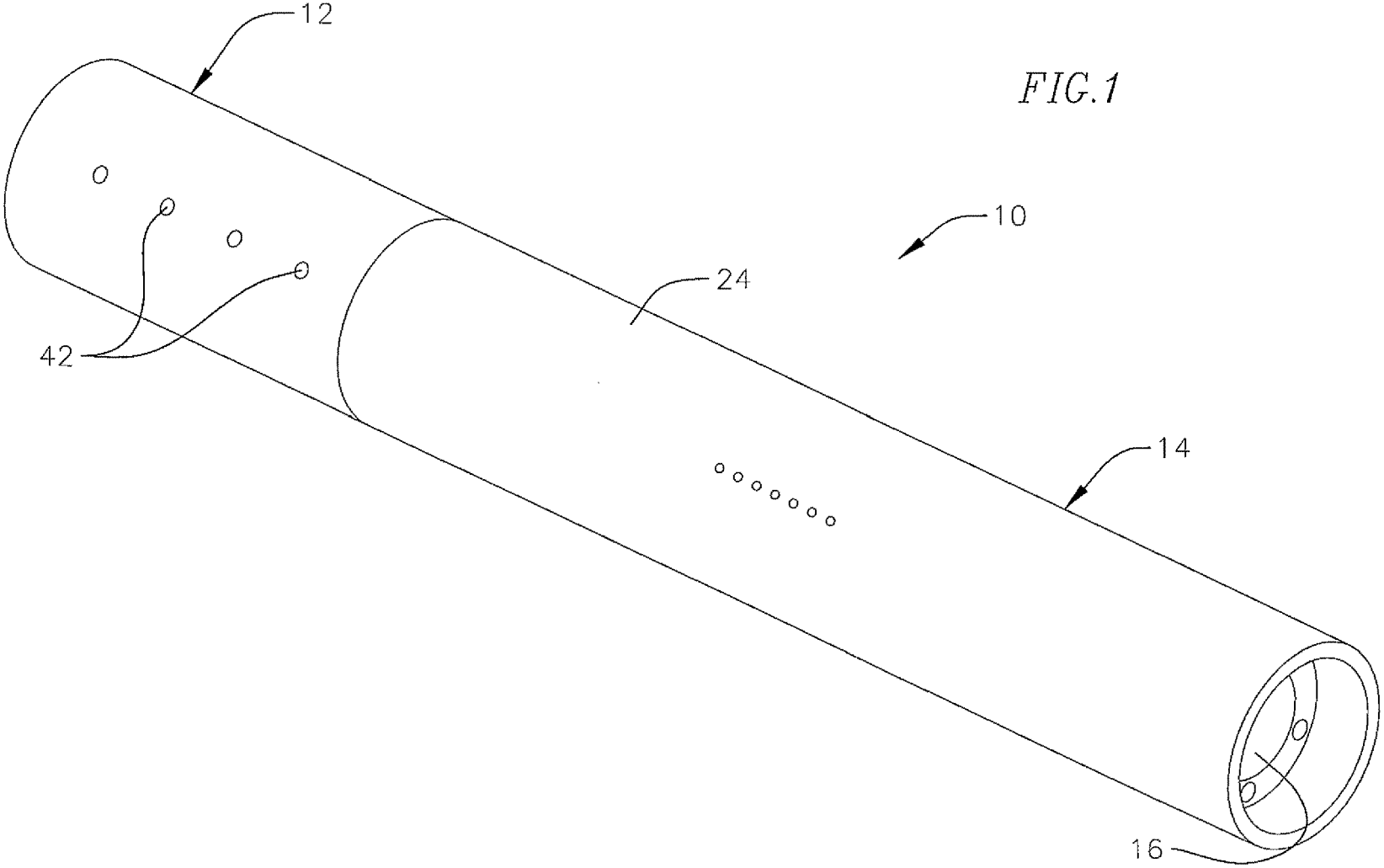
FIG. 1 is a perspective view of the oscillating mud motor of the present invention.
Figure 2:
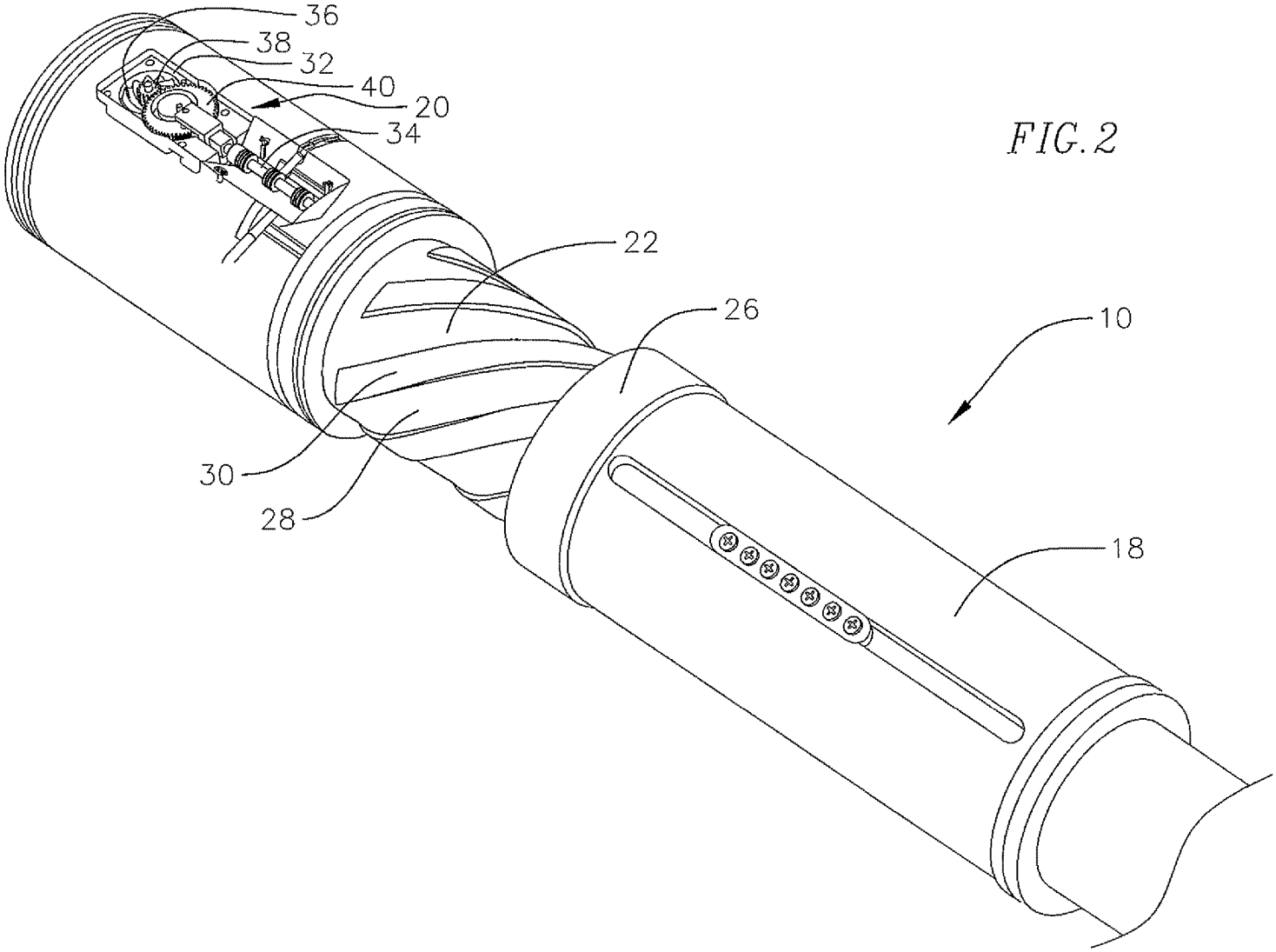
FIG. 2 is a perspective view of the motor of FIG. 1 with the outer coverings for the valve system and the piston removed.

Referring to FIGS. 1 and 2, an oscillating mud motor 10 of the present invention is illustrated. The motor 10 includes a valve section 12 and a piston section 14. The motor 10 is cylindrical in shape having a hollow interior 16.

The motor 10 utilizes a rotationally reciprocating piston 18 controlled by a hydraulic valve 20. The piston 18 is positioned in the piston section 14 between a central shaft 22 and an outer cylinder 24. The piston 18 is coupled to the central shaft 22 by a sleeve 26 attached to an end of the piston. Central shaft 22 and sleeve 26 are keyed to one another by having a plurality of spiral grooves 28 and raised ridges 30 on the outside diameter of the central shaft and corresponding internal diameter of the sleeve 26. The keyed grooves extend along the axial length of the central shaft providing the distance of travel for the piston. The helical feature in the piston by way of the sleeve causes the outer cylinder 24 to rotate relative to the central shaft 22. As the piston moves forwards and backwards on the shaft, the linear motion is translated into oscillating angular motion relative to the shaft.

The hydraulic valve 20 causes axial movement of the piston on the shaft. The hydraulic motion is controlled using the hydraulic valve 20 which includes a timing cycle valve 32 and a 4-way spool valve 34 attached to the timing cycle valve. A turbine 36 is positioned within the timing cycle valve and is fed with pressurized fluid from within the drill pipe or casing and the turbine rotor spins when differential pressure is applied between the center line fluid within the motor and the drilling annulus. The spinning turbine is slowed using a series of gears 38, 40 and turned into reciprocating linear motion to drive the 4-way spool valve 34. The rotational motion of the turbine being slowed by the gears and turned into reciprocating linear motion to cycle the 4-way spool valve directs fluid to the oscillating piston 18. This cycles the valve back and forth at a rate proportional to the flow rate through the turbine, which is in turn proportional to the flow rate and differential pressure present within the drill string or casing string. The hydraulic valve 20 includes vents 42 for the drilling fluid to exit into the annulus.

The oscillating mud motor of the present invention, can be sized depending upon the particular requirements of the drill string or casing or liner, but for example can have a 5.13 inch outside diameter, a 3.25 inch inside diameter and be 37 inches long. One benefit of the oscillating mud motor of the present invention is in the arrangement of the valve to piston which provides for the improved ease of manufacturing and sealing of the pistons and hydraulic chambers required to generate a differential pressure compared to generate force within the motor. An advantage of the present invention is the hollow center bore allowing flow through the motor which allows drilling additional sections through the motor. A typical 5.13 inch OD by a 3.25 inch ID motor can generate approximately 1 foot pound of torque per PSI of differential pressure, which means that a typical usable 1,500 PSI of differential pressure, the motor can general 1,500 foot pounds of torque, which is enough to allow approximately 5,000 to 10,000 pounds of weight on a drill bit. This weight on bit is enough for most reamers or drill bits to operate effectively and the torque generated is enough for effective reaming and drilling using a drillable reamer to work effectively to ream 5,000 to 15,000 PSI compressive strength rock. A motor of this size also requires only 10 to 20 GPM of flow to run at an equivalent 60 RPM. Consequently if a nozzle is included below the motor that creates 1,500 PSI of differential pressure at 100 to 200 GPM, only 5 to 20 percent of the flow is going through the motor, so stalling will not cause a significant spike in pressure. Consequently other sensitive pressure activated tools can be used with the motor of the present invention. The motor, can be made less than five to six feet in length including a reamer bit, so it would not require increased overlap of the liner string, nor would it interfere with current cementing practices. Additional valves can be included in the tool to activate the tool only when needed at pre-determined pressures or flow rates, or to completely deactivate the tool if needed.

Figure 3:
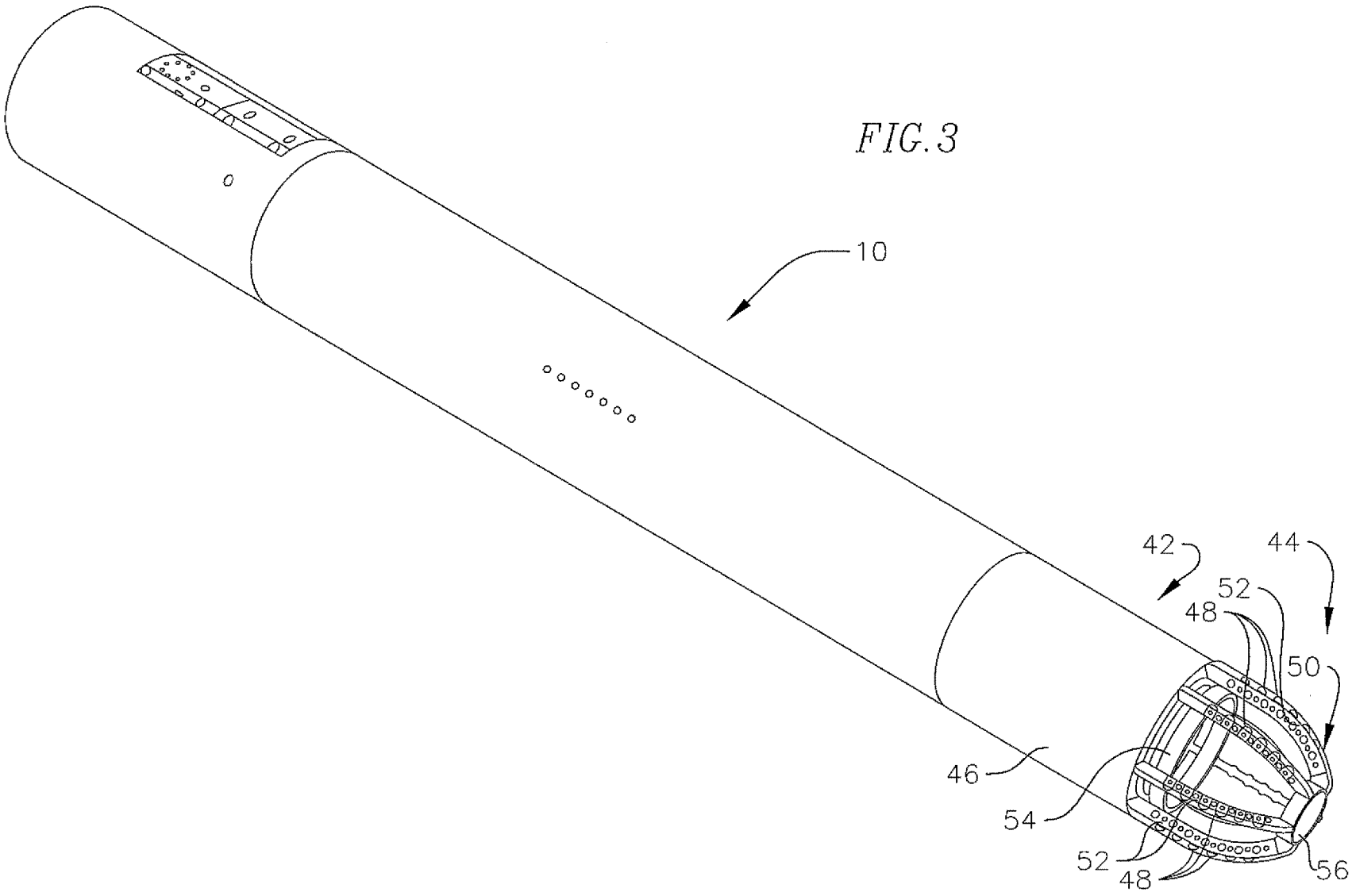
FIG. 3 is a perspective view of the motor of FIG. 1 as attached to a reamer shoe.

FIG. 3 illustrates the mud motor 10 as attached to a reamer shoe attachment 42. The reamer shoe 42 includes a reamer bit 44 attached to an aluminum connector 46. Reamer bit 44 is utilized to open a drilled hole and smooth areas that may have ledges or under-gauge areas where the diameter of the hole is not large enough to allow passage of a casing. The reamer bit 44 includes a plurality of ceramic inserts 48 made from Silicon Nitride and/or Aluminum Oxide. Silicon Nitride and Aluminum Oxide are harder than most rock materials and are easily broken up and flushed harmlessly out of the hole when it is required to drill through the reamer shoe when drilling the next wellbore section. The inserts 48 are held in the reamer bit by a metallic cage 50 comprising a plurality of curved cage members 52 spaced around the circumference of the nose section. Cage 50 also includes reinforced rings 54 and 56 for attachment of the cage members 52 to one another. The cage 50 locates the inserts at the proper position and provides a load bearing structure to support the loads and conduct heat away from the inserts. The cage will preferably be made using a strong and lightweight aluminum alloy, but could also be made from steel.

The cage 50 and inserts 48 can be cast using liquid materials that solidify to form a solid structure including polyurethane and polyurea elastomers; epoxy and vinyl ester thermoset plastics; cast and nylon plastic; and aluminum, brass, bronze or zinc metallic alloys. A polymer covering would be positioned over the reamer bit.

Figure 4:
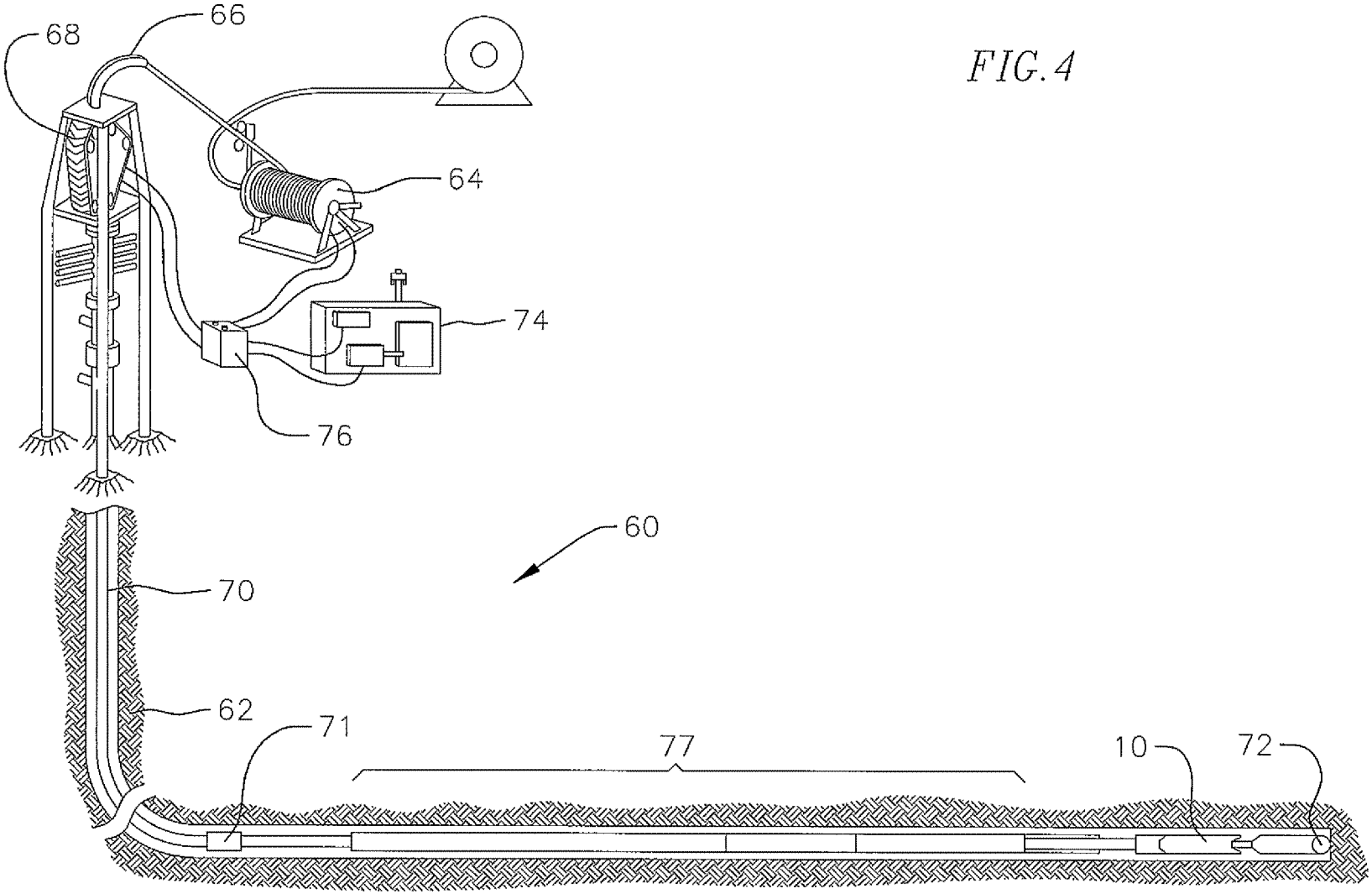
FIG. 4 is a schematic view showing a down hole assembly containing the motor of FIG. 1 in a drilling operation.

FIG. 4 illustrates the incorporation of the mud motor 10 of the present invention into a drill string 60, which in this illustration is a coiled tubing drilling system for drilling a wellbore in an underground formation 62. The coiled tubing drilling system can include a coiled tubing reel 64, a gooseneck tubing guide 66, a tubing injector 68, a coiled tubing 70, a coiled tubing connector 71 and a drill bit 72 at the bottom on the wellbore. The drilling system also includes a control cab 74, a power pack 76 and an alignment of other bottom hole assembly tools 77 as needed. This arrangement is all well-known in the art. During drilling, the down hole equipment includes the oscillating mud motor 10 adjacent the drill bit.

Although the present invention has been described and illustrated with respect to our preferred embodiment thereof, it is to be understood that changes and modifications can be made therein which are in the full intended scope of the invention as hereinafter claimed.

What is claimed is:

1. An oscillating mud motor comprising:

a valve section; and a piston section having a piston;

wherein the valve section and the piston section are cylindrical and have a hollow interior, and wherein the valve section hydraulically controls rotational movement of the piston for simultaneous linear axial reciprocation within the piston section.

2. The motor of claim 1, wherein the valve section comprises a timing cycle valve and a spool valve.

3. The motor of claim 2, wherein the timing cycle valve includes a turbine and gears.

4. The motor of claim 2, wherein the spool valve is a 4-way spool valve.

5. The motor of claim 1, wherein the piston section includes:

an outer cylindrical housing;

a central shaft; and a piston position between the outer cylindrical housing and the central shaft.

6. The motor of claim 5, wherein the central shaft is keyed with spiral grooves on an outside diameter of the central shaft.

7. The motor of claim 6, wherein the piston has a sleeve with keyed spiral grooves on an inside diameter of the sleeve.

8. The motor of claim 1, further comprising a reamer shoe positioned on a down hole end of the motor.

9. The motor of claim 1, wherein the motor is positioned in a drill string bottom hole assembly.

10. A down hole motor for use in a wellbore comprising:

a cylindrical housing;

a timing cycle valve including a turbine and gears and a 4-way spool valve positioned in the housing; and a piston positioned in the housing hydraulically attached to the spool valve for hydraulically imparting rotational movement to the piston for axial reciprocation within the cylindrical housing.

11. The motor of claim 10, wherein the piston is positioned on a central shaft within the cylindrical housing.

12. The motor of claim 11, wherein the central shaft is keyed with spiral grooves on an outside diameter of the central shaft.

13. The motor of claim 12, wherein the piston has a sleeve with keyed spiral grooves on an inside diameter shaft which cooperate with the spiral grooves on the outside diameter of the central shaft.

14. The motor of claim 10, further comprising a reamer shoe positioned on a down hole end of the motor.

15. The motor of claim 10, wherein the motor is positioned in a drill stringed bottom hole assembly.

16. An oscillating mud motor for a down hole drilling assembly comprising a cylindrical hollow housing having a valve hydraulically controlling a linearly reciprocating piston within the housing by rotational movement on a shaft in the housing;

wherein the piston is positioned on a central shaft having spiral grooves on an outside diameter of the central shaft and wherein the piston has a sleeve having spiral grooves on an inside diameter of the sleeve which cooperate with the spiral grooves on the outside diameter of the central shaft.

17. The motor of claim 16, wherein the valve comprises a timing valve including a turbine and gears, and a 4-way spool valve.

* * * * *